US010281170B2

(12) United States Patent
Sukumaran et al.

(10) Patent No.: US 10,281,170 B2
(45) Date of Patent: May 7, 2019

(54) SEALED REFRIGERATION SYSTEM AND APPLIANCE

(71) Applicant: Haier US Appliance Solutions, Inc., Wilmington, DE (US)

(72) Inventors: Mogan Sukumaran, Hyderabad (IN); Saravanan Rajamanickam, Hyderabad (IN); Gregory Leon Hutchison, Shelbyville, KY (US); Alan G. Constance, Jeffersonville, IN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 98 days.

(21) Appl. No.: 15/237,680

(22) Filed: Aug. 16, 2016

(65) Prior Publication Data

US 2018/0051909 A1 Feb. 22, 2018

(51) Int. Cl.

| | |
|---|---|
| ***F24H 4/04*** | (2006.01) |
| ***F24H 9/20*** | (2006.01) |
| ***F25B 1/00*** | (2006.01) |

(52) U.S. Cl.

CPC ..... *F24H 4/04* (2013.01); *F24H 9/2007* (2013.01); *F25B 1/00* (2013.01)

(58) Field of Classification Search

CPC ..... F24H 4/04; F24H 9/2007; F25D 19/00; F16K 5/00

See application file for complete search history.

(56) References Cited

U.S. PATENT DOCUMENTS 2,632,306 A * 3/1953 Ruff ..... F24F 5/00 165/240
4,796,436 A * 1/1989 Voorhis ..... F25B 45/00 62/149
5,358,009 A * 10/1994 Cambell ..... B67D 7/002 137/209

(Continued)

FOREIGN PATENT DOCUMENTS

JP 2009068737 A * 4/2009
JP 2015078767 A 4/2015

OTHER PUBLICATIONS

Tanigawa et al., Refrigerator, Apr. 2, 2009, JP2009068737A, Whole Document.*

*Primary Examiner* — Larry L Furdge
(74) *Attorney, Agent, or Firm* — Dority & Manning, P.A.

(57) ABSTRACT

A sealed refrigeration system and appliance are provided. The sealed refrigeration system may include a compressor, a condenser, an evaporator, and a check valve assembly. The compressor may be operable to compress refrigerant, while the condenser may be disposed in downstream fluid communication with the compressor to condense refrigerant received from the compressor. The evaporator may be disposed in fluid communication between the condenser and the compressor. The check valve assembly may be disposed in fluid communication between at least two components of the sealed refrigeration system. The check valve assembly may include a valve body defining a circuit inlet, a circuit outlet, and a charge port. The circuit outlet may be downstream from the circuit inlet to direct refrigerant therefrom. The charge port may be between the circuit inlet and the circuit outlet to receive refrigerant therethrough.

16 Claims, 7 Drawing Sheets

(56) References Cited

U.S. PATENT DOCUMENTS

| | | | | |
|---|---|---|---|---|
| 6,227,003 | B1 * | 5/2001 | Smolinsky | F25B 9/008 62/324.1 |
| 7,516,942 | B2 * | 4/2009 | Grau | F16K 5/0414 251/152 |
| 8,695,642 | B2 | 4/2014 | Danielson et al. | |

* cited by examiner

SEALED REFRIGERATION SYSTEM AND APPLIANCE

FIELD OF THE INVENTION

The present subject matter relates generally to heat exchange appliances, and more particularly to appliances including sealed refrigeration systems.

BACKGROUND OF THE INVENTION

Heat exchanging appliances, such as water heaters, may include a sealed refrigeration system. Generally, sealed refrigeration systems circulate a set mass of refrigerant about a closed loop, such as through a compressor element. During heat exchange operations, heat absorbed at one portion of the loop may be transferred to the refrigerant before being circulated to another portion of the loop. In some systems, multiple discrete conduits or joints are connected to each other and to separate elements of the sealed refrigeration system. Together, the connected conduits form the closed loop.

Although sealed refrigeration systems generally provide a predetermined or set mass of refrigerant within the closed loop, instances may arise in which a portion of refrigerant needs to be added or removed from the closed loop. For instance, during assembly of the system, an initial charge of refrigerant may be provided to the system. In addition, many maintenance operations may require draining refrigerant from at least a portion of the closed loop. In order to facilitate the addition or removal of refrigerant, some appliances include one or more process tubes that are connected within the closed loop of the sealed refrigeration system. In some instances, the process tube is fixed to a separate joint, such as a T-joint, between two separate conduits. During heat exchange operations, the process tube is generally sealed. Refrigerant flows along the closed loop through the T-joint, but refrigerant within the process tube is largely static. When refrigerant needs to be added or removed from the closed loop, the process tube may be unsealed, and refrigerant may flow therethrough as it is added/removed from the sealed system. Although these existing configurations allow for the introduction or removal of refrigerant, they also introduce potential failure or leak points for the sealed system. For instance, over time, a T-joint may start to leak as the sealing connection fails.

Accordingly, there is a need for further improvements in the field of heat exchange appliances. It would be advantageous if a sealed system or appliance was provided that addressed some of the problems identified above.

BRIEF DESCRIPTION OF THE INVENTION

Aspects and advantages of the invention will be set forth in part in the following description, or may be obvious from the description, or may be learned through practice of the invention.

In one aspect of the present disclosure, a sealed refrigeration system is provided. The sealed refrigeration system may include a compressor, a condenser, an evaporator, and a check valve assembly. The compressor may be operable to compress refrigerant, while the condenser may be disposed in downstream fluid communication with the compressor to condense refrigerant received from the compressor. The evaporator may be disposed in fluid communication between the condenser and the compressor. The check valve assembly may be disposed in fluid communication between at least two components of the sealed refrigeration system. The check valve assembly may include a valve body defining a circuit inlet, a circuit outlet, and a charge port. The circuit inlet may receive refrigerant within the sealed refrigeration system. The circuit outlet may be downstream from the circuit inlet to direct refrigerant therefrom. The charge port may be between the circuit inlet and the circuit outlet to receive refrigerant therethrough.

In another aspect of the present disclosure, an appliance is provided. The appliance may include a heat exchange body and a sealed refrigeration system. The heat exchange body may include a sidewall defining an interior volume for receiving fluid. The sealed refrigeration system may be positioned in thermal engagement with the heat exchange body. The sealed refrigeration system may include a compressor, a condenser, an evaporator, and a check valve assembly. The compressor may be operable to compress refrigerant, while the condenser may be disposed in downstream fluid communication with the compressor to condense refrigerant received from the compressor. The evaporator may be disposed in fluid communication between the condenser and the compressor. The check valve assembly may be disposed in fluid communication between at least two components of the sealed refrigeration system. The check valve assembly may include a valve body defining a circuit inlet, a circuit outlet downstream from the circuit inlet, and a charge port between the circuit inlet and the circuit outlet to receive refrigerant therethrough. The check valve assembly may also include a process tube disposed through the charge port in fluid communication with the valve body to deliver refrigerant to the check valve assembly.

In yet another aspect of the present disclosure, a water heater appliance is provided. The water heater appliance may include a tank that includes a sidewall defining an interior volume, as well as and a sealed system for heating water within the interior volume. The heat exchange body may include a sidewall defining an interior volume for receiving fluid. The sealed refrigeration system may be positioned in thermal engagement with the heat exchange body. The sealed refrigeration system may include a compressor, a condenser, an evaporator, and a check valve assembly. The compressor may be operable to compress refrigerant, while the condenser may be disposed in downstream fluid communication with the compressor to condense refrigerant received from the compressor. The evaporator may be disposed in fluid communication between the condenser and the compressor. The check valve assembly may be disposed in fluid communication between at least two components of the sealed system. The check valve assembly may include a valve body defining a circuit inlet, a circuit outlet downstream from the circuit inlet, and a charge port between the circuit inlet and the circuit outlet to receive refrigerant therethrough. The check valve assembly may also include a process tube disposed through the charge port in fluid communication with the valve body to deliver refrigerant to the check valve assembly.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
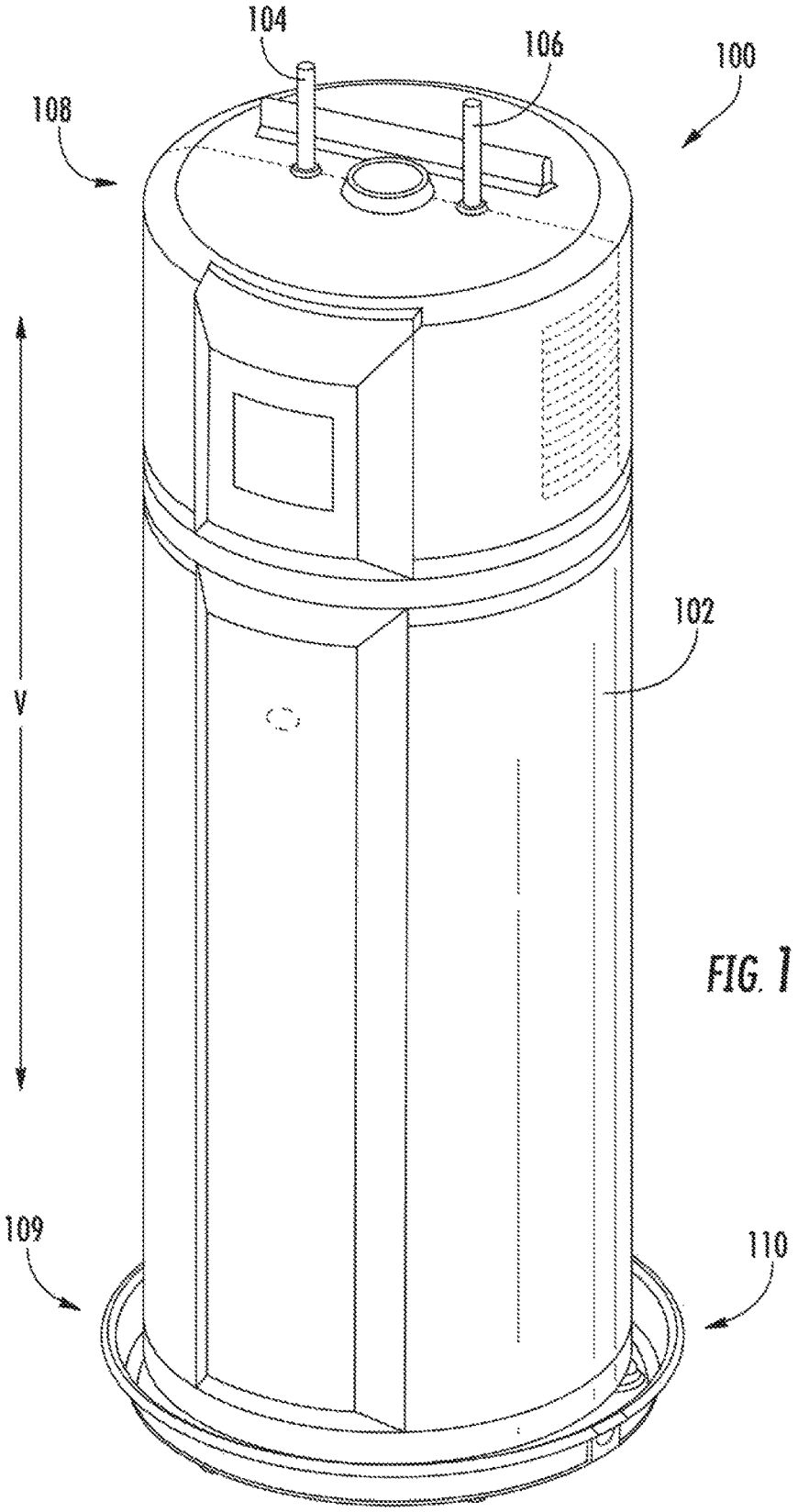
FIG. 1 provides a perspective view of a water heater according to an exemplary embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
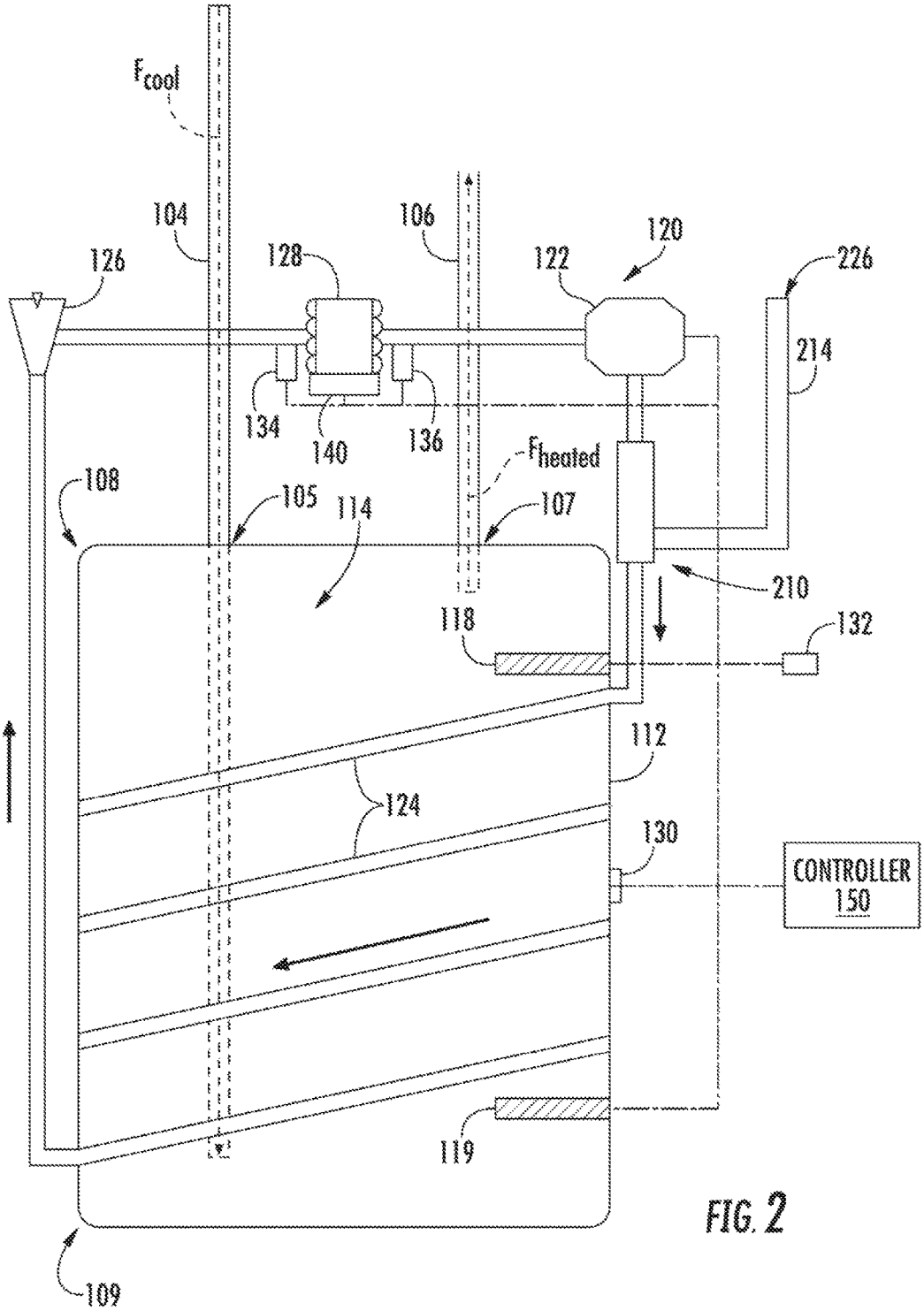
FIG. 2 provides a schematic view of certain components of the exemplary water heater appliance of FIG. 1.
Figure 3:
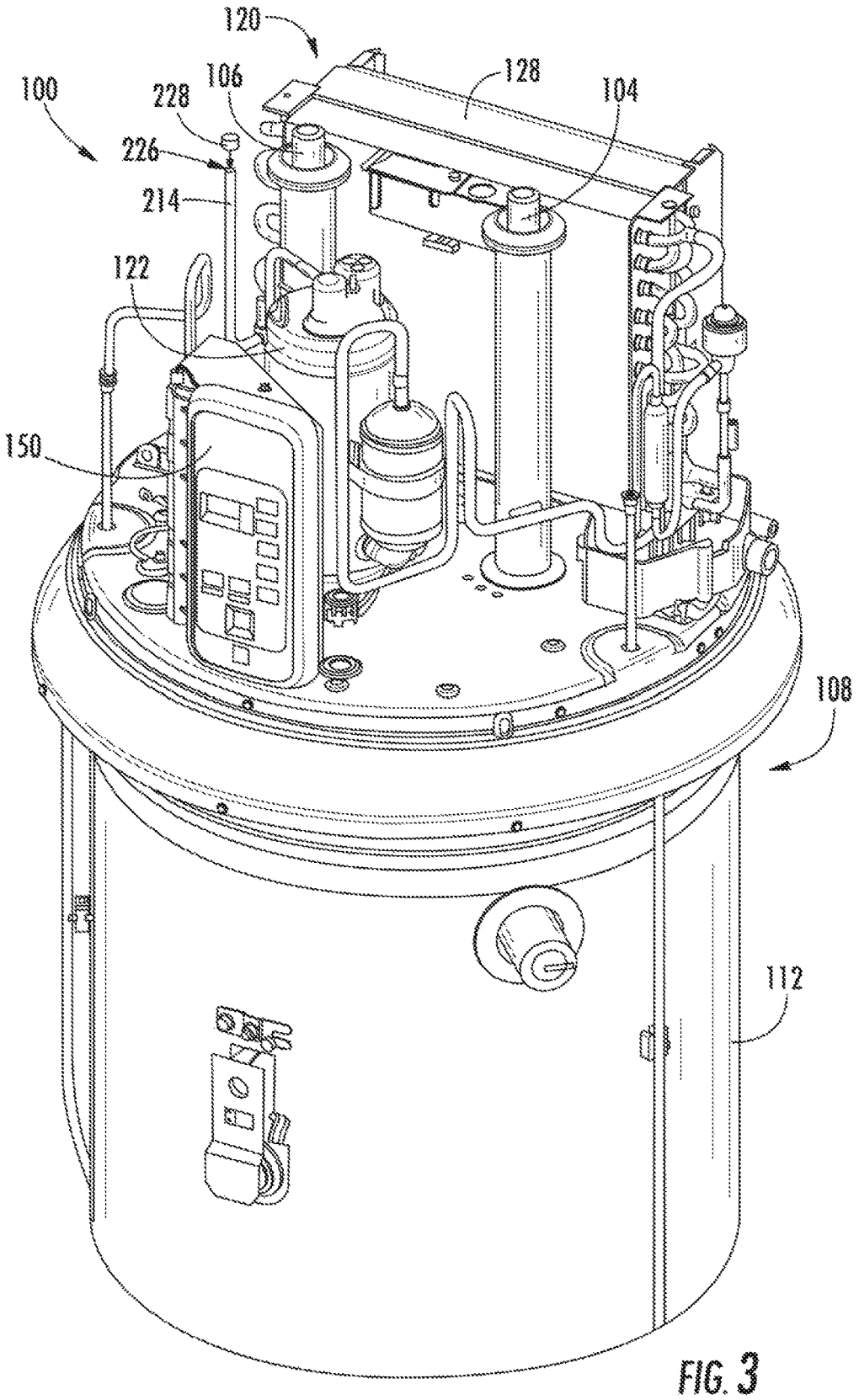
FIG. 3 provides a partial, perspective view of the exemplary water heater appliance of FIG. 1.
Figure 4:
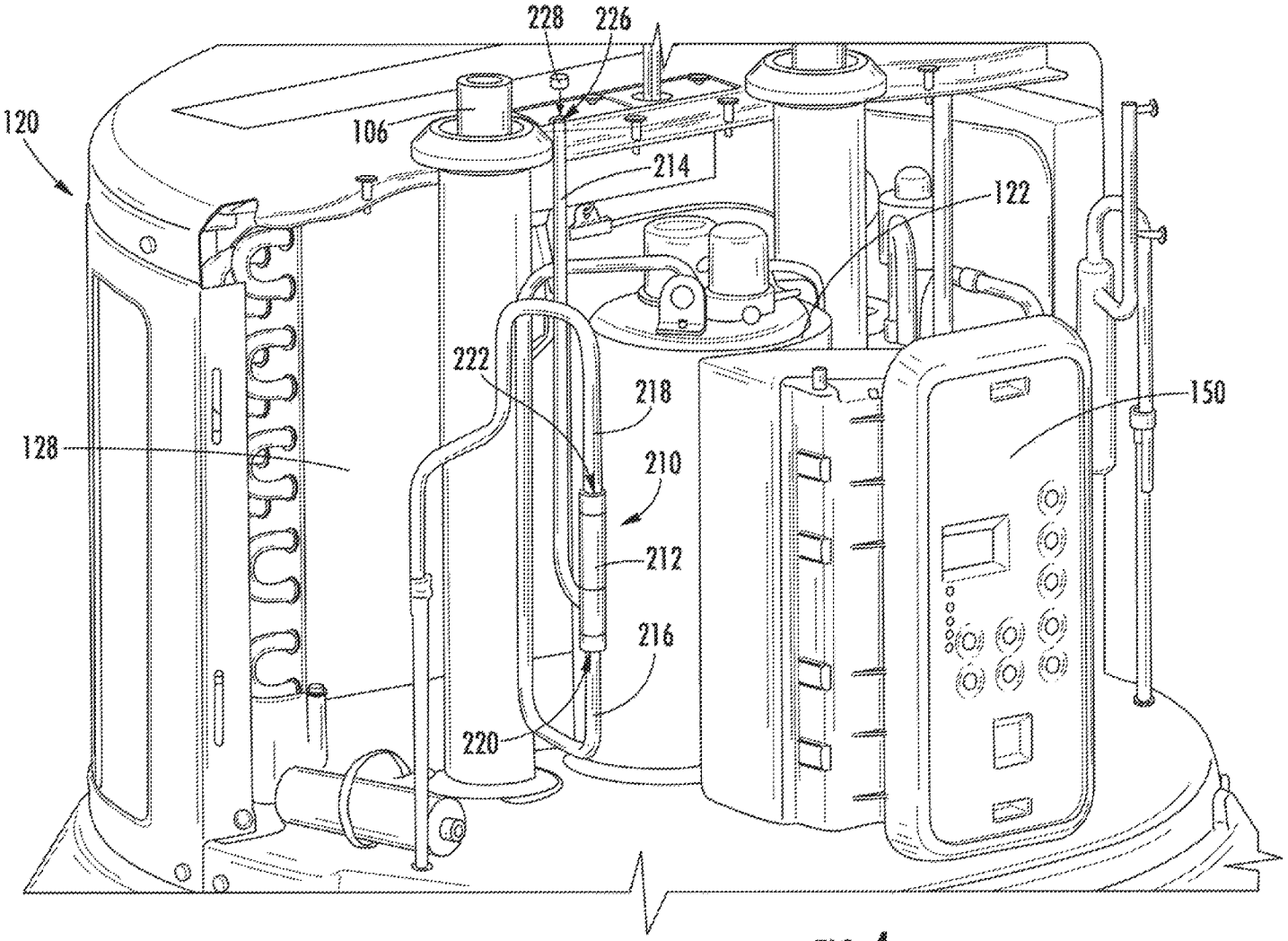
FIG. 4 provides another partial, perspective view of the exemplary water heater appliance of FIG. 1
Figure 5:
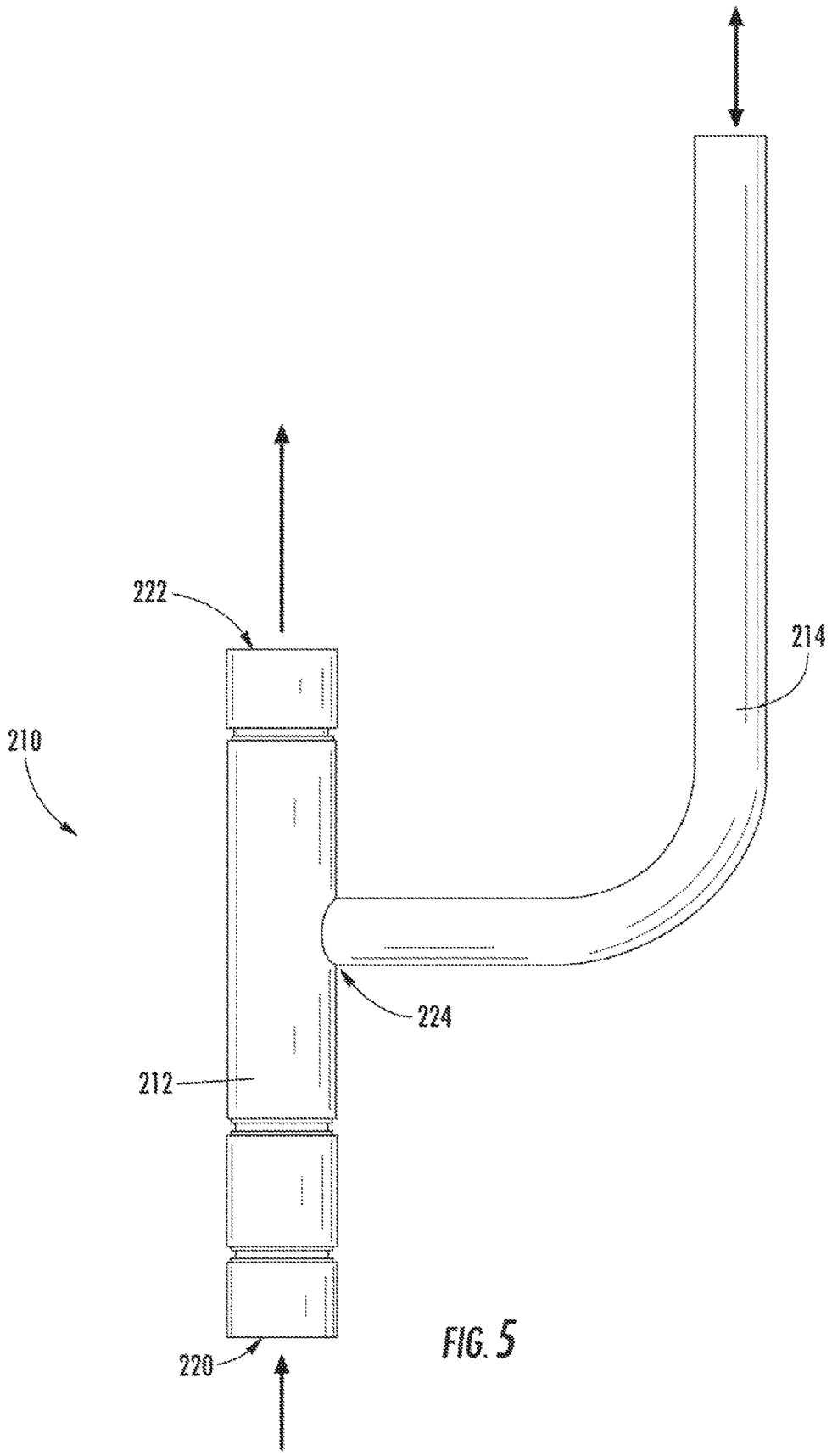
FIG. 5 provides a side view of a check valve assembly of an exemplary water heater appliance.
Figure 6:
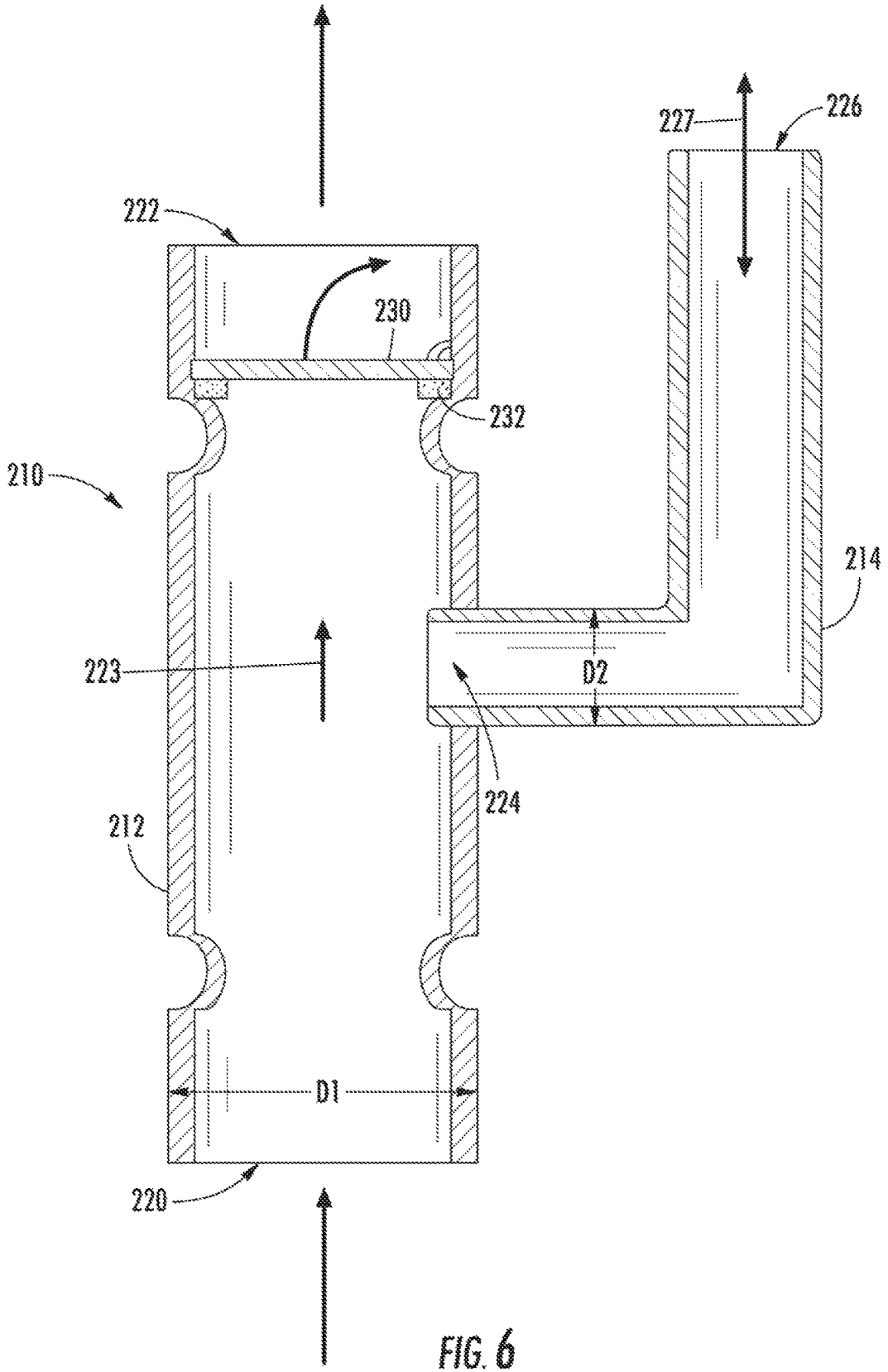
FIG. 6 provides a cross-sectional schematic view of a check valve assembly of an exemplary water heater appliance, wherein a process tube is disposed upstream from a valve mechanism.
Figure 7:
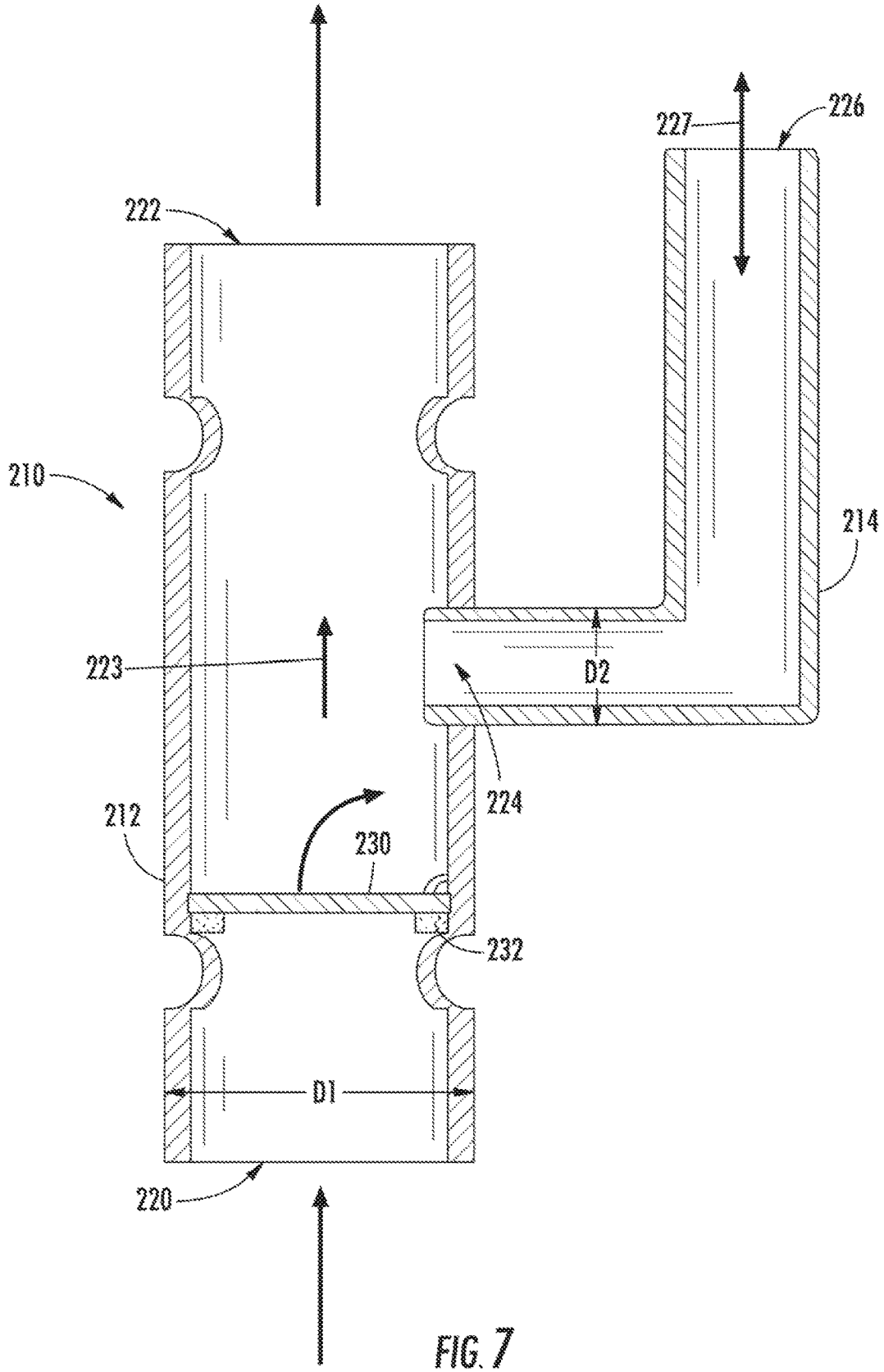
FIG. 7 provides a cross-sectional schematic view of a check valve assembly of an exemplary water heater appliance, wherein a process tube is disposed downstream from a valve mechanism.

FIG. 1 provides a perspective view of an exemplary appliance. Specifically, FIG. 1 provides water heater appliance 100 according to an exemplary embodiment of the present disclosure. FIG. 2 provides a schematic view of certain components of water heater appliance 100. FIGS. 3 and 4 provide perspective views of an exemplary sealed system 120 mounted on water heater appliance 100. FIGS. 5 through 7 provide side views of a portion of the exemplary sealed system 120, including a check valve assembly 210. Although the figures illustrate the appliance as a water heater appliance 100, it is understood that the present disclosure is not limited to such embodiments. For instance, as described herein, and except as otherwise indicated, the appliance of the present disclosure may include another appliance having a sealed refrigeration system, such as a refrigerator appliance, air conditioning appliance, etc.

As may be seen in FIGS. 1 and 2, water heater appliance 100 includes a casing 102 and a tank 112 mounted within casing 102. Optionally, casing 102 surrounds a tank 112, e.g., at a sidewall of tank 112, such that tank 112 is disposed within casing 102. Tank 112 defines an interior volume 114 for heating water therein. Water heater appliance 100 also includes an inlet conduit 104 and an outlet conduit 106 that are both in fluid communication with tank 112 within casing 102. As an example, cold water from a water source, e.g., a municipal water supply or a well, enters water heater appliance 100 through inlet conduit 104. From inlet conduit 104, such cold water enters interior volume 114 of tank 112, wherein the water is heated to generate heated water. Such heated water exits water heater appliance 100 at outlet conduit 106 and may be supplied to a bath, shower, sink, or any other suitable feature. As will be understood by those skilled in the art and as used herein, the term "water" includes purified water and solutions or mixtures containing water and, e.g., elements (such as calcium, chlorine, and fluorine), salts, bacteria, nitrates, organics, and other chemical compounds or substances.

As may be seen in FIG. 1, water heater appliance 100 extends between a top portion 108 and a bottom portion 109 along a vertical direction V to have a generally vertical orientation. Water heater appliance 100 can be leveled, e.g., such that casing 102 is plumb in the vertical direction V, in order to facilitate proper operation of water heater appliance 100.

A drain pan 110 is positioned at bottom portion 109 of water heater appliance 100 such that water heater appliance 100 sits on drain pan 110. Drain pan 110 sits beneath water heater appliance 100 along the vertical direction V, e.g., to collect water that leaks from water heater appliance 100 or water that condenses on an evaporator 128 of water heater appliance 100.

Turning now to FIGS. 2 through 4, water heater appliance 100 includes an upper heating element 118, a lower heating element 119, and a sealed system 120 for heating water within interior volume 114 of tank 112. Upper and lower heating elements 118, 119 may be any suitable heating elements. For example, upper heating element 118 and/or lower heating element 119 may be an electric resistance element, a microwave element, an induction element, or any other suitable heating element or combination thereof. Lower heating element 119 may also be a gas burner.

In some embodiments, sealed system 120 includes a multiple components, including a compressor 122, a condenser 124, a throttling device 126, and an evaporator 128. Condenser 124 is thermally coupled or assembled in a heat exchange relationship with tank 112 in order to heat water within interior volume 114 of tank 112 during operation of sealed system 120. In exemplary embodiments, condenser 124 is a conduit coiled around and mounted to tank 112. Condenser 124 may be optionally positioned in downstream fluid communication with compressor 122. Moreover, condenser 124 may be positioned in upstream fluid communication with evaporator 128, such that evaporator is disposed in fluid communication between condenser 124 and compressor 122. Prior to operation, a fluid refrigerant may be supplied to sealed system 120, e.g., through one or more process tubes 214. Optionally, each process tube 214 may be formed from one or more suitable conductive materials, e.g., copper.

During operation of sealed system 120, refrigerant exits evaporator 128 as a fluid in the form of a superheated vapor and/or high quality vapor mixture. Upon exiting evaporator 128, the refrigerant enters compressor 122 wherein the pressure and temperature of the refrigerant are increased such that the refrigerant becomes a superheated vapor. Generally, compressor 122 is suitable to motivate refrigerant through the sealed system 120 during operations. For instance, compressor 122 may be provided as a gear-driven rotary compressor. Rotary compressor may include a rolling piston (not pictured) eccentrically mounted to rotate in a compression space of a cylinder having a vane contacted with a rolling piston for partitioning the compression space of the cylinder into a suction chamber and a discharge chamber. From compressor 122, refrigerant may flow in a single fluid direction to condenser 124.

Before entering condenser 124 and after exiting compressor 122, superheated vapor passes through check valve assembly 210 in fluid communication between compressor 122 and condenser 124. For instance, superheated vapor may flow through a first conduit 216 extending from compressor 122 to check valve assembly 210. From check valve assembly 210, superheated vapor may then flow through a second conduit 218 extending from check valve assembly 210 to condenser 124. Each conduit 216, 218 may be formed from one or more suitable conductive materials, e.g., copper, and connect to opposite ends of a valve body 212 of the check valve assembly 210. Each conduit 216, 218 may be a single segment or may include multiple discrete segments, e.g., pipe segments, joined together along a single fluid path. As illustrated, in some embodiments first conduit 216 connects to a circuit inlet 220 of the valve body 212, while second conduit 218 connects to a circuit outlet 222 of the valve body 212. In some such embodiments, each conduit 216, 218 may form a fluidly sealed connection, e.g., via brazing, with valve body 212 at a respective end 220, 222. Check valve assembly 210 may generally permit refrigerant to flow along a set direction from compressor 122 to condenser 124, while restricting flow in the opposite direction, e.g., when compressor 122 is halted or otherwise disengaged.

During operation, the superheated vapor from compressor 122 and check valve assembly 210 enters condenser 124, e.g., through second conduit 218, wherein condenser 124 transfers energy to the water within tank 112 and condenses into a saturated liquid and/or high quality liquid vapor mixture. High quality/saturated liquid vapor mixture exits condenser 124 and travels through throttling device 126. Throttling device 126 may generally expand the refrigerant, lowering the pressure and temperature thereof. Upon exiting throttling device 126, the pressure and temperature of the refrigerant drop at which time the refrigerant enters evaporator 128 and the cycle repeats itself.

Throttling device 126 may be any suitable components for generally expanding the refrigerant. For example, in some exemplary embodiments, throttling device 126 may be a Joule-Thomson expansion valve, also known as a "J-T valve." In certain exemplary embodiments, throttling device 126 may be an electronic expansion valve (EEV).

A fan or air handler 140 may assist with heat transfer between air about water heater appliance 100, e.g., within casing 102, and refrigerant within evaporator 128. Air handler 140 may be positioned within casing 102 on or adjacent to evaporator 128. When activated, air handler 140 may direct a flow of air towards or across evaporator 128, and the flow of air from air handler 140 may assist with heating refrigerant within evaporator 128. Air handler 140 may be any suitable type of air handler, such as an axial or centrifugal fan.

Exemplary embodiments of water heater appliance 100 also include a tank temperature sensor 130. Generally tank temperature sensor 130 is configured for measuring a temperature of water within interior volume 114 of tank 112. Tank temperature sensor 130 can be positioned at any suitable location within or on water heater appliance 100. For example, tank temperature sensor 130 may be positioned within interior volume 114 of tank 112 or may be mounted to tank 112 outside of interior volume 114 of tank 112. When mounted to tank 112 outside of interior volume 114 of tank 112, tank temperature sensor 130 may be configured for indirectly measuring the temperature of water within interior volume 114 of tank 112. For example, tank temperature sensor 130 may measure the temperature of tank 112 and correlate the temperature of tank 112 to the temperature of water within interior volume 114 of tank 112. Tank temperature sensor 130 may also be positioned at or adjacent to top portion 108 of water heater appliance 100, e.g., at or adjacent to an inlet of outlet conduit 106.

Tank temperature sensor 130 may be any suitable temperature sensor. For example, tank temperature sensor 130 may be a thermocouple or a thermistor. In certain embodiments, such as that of FIG. 2, tank temperature sensor 130 is the only temperature sensor positioned at or on tank 112 that is configured for measuring the temperature of water within interior volume 114 of tank 112. In alternative exemplary embodiments, additional temperature sensors may be positioned at or on tank 112 to assist tank temperature sensor 130 with measuring the temperature of water within interior volume 114 of tank 112, e.g., at other locations within interior volume 114 of tank 112.

In some embodiments, water heater appliance 100 also includes an ambient temperature sensor 132, an evaporator inlet temperature sensor 134 and an evaporator outlet temperature sensor 136. Ambient temperature sensor 132 is configured for measuring a temperature of air about water heater appliance 100. Ambient temperature sensor 132 may be positioned at any suitable location within or on water heater appliance 100. For example, ambient temperature sensor 132 may be mounted to casing 102, e.g., at or adjacent to top portion 108 of water heater appliance 100. Ambient temperature sensor 132 may be any suitable temperature sensor. For example, ambient temperature sensor 132 may be a thermocouple or a thermistor.

In certain embodiments, evaporator inlet temperature sensor 134 is configured for measuring a temperature of refrigerant at or adjacent to inlet of evaporator 128. As illustrated in FIG. 2, evaporator inlet temperature sensor 134 may be positioned at or adjacent to inlet of evaporator 128. Optionally, evaporator inlet temperature sensor 134 may be mounted to tubing that directs refrigerant into evaporator 128, e.g., at or adjacent to inlet of evaporator 128. When mounted to tubing, evaporator inlet temperature sensor 134 may indirectly measure the temperature of refrigerant at inlet of evaporator 128. For example, evaporator inlet temperature sensor 134 may measure the temperature of the tubing and correlate the temperature of the tubing to the temperature of refrigerant at inlet of evaporator 128. Evaporator inlet temperature sensor 134 may be any suitable temperature sensor. For example, evaporator inlet temperature sensor 134 may be a thermocouple or a thermistor.

In optional embodiments, evaporator outlet temperature sensor 136 is configured for measuring a temperature of refrigerant at or adjacent to outlet of evaporator 128. As illustrated in FIG. 2, evaporator outlet temperature sensor 136 may be positioned at or adjacent to outlet of evaporator 128. Optionally, evaporator outlet temperature sensor 136 may be mounted to tubing that directs refrigerant out of evaporator 128, e.g., at or adjacent to outlet of evaporator 128. When mounted to tubing, evaporator outlet temperature sensor 136 may indirectly measure the temperature of refrigerant at outlet of evaporator 128. For example, evaporator outlet temperature sensor 136 may measure the temperature of the tubing and correlate the temperature of the tubing to the temperature of refrigerant at outlet of evaporator 128. Evaporator outlet temperature sensor 136 may be any suitable temperature sensor. For example, evaporator outlet temperature sensor 136 may be a thermocouple or a thermistor.

In exemplary embodiments, water heater appliance 100 further includes a controller 150 that is configured to regulate operation of water heater appliance 100. Controller 150 is in, e.g., operative, communication with upper heating element 118, lower heating element 119, compressor 122, tank temperature sensor 130, ambient temperature sensor 132, evaporator inlet temperature sensor 134, evaporator outlet temperature sensor 136, and air handler 140. Controller 150 may selectively activate upper and lower heating elements 118 and 119 and/or compressor 122 in order to heat water within interior volume 114 of tank 112, e.g., in response to signals from tank temperature sensor 130, ambient temperature sensor 132, evaporator inlet temperature sensor 134, and/or evaporator outlet temperature sensor 136.

Controller 150 includes memory and one or more processing devices such as microprocessors, CPUs or the like, such as general or special purpose microprocessors operable to execute programming instructions or micro-control code associated with operation of water heater appliance 100. The memory can represent random access memory such as DRAM, or read only memory such as ROM or FLASH. The processor executes programming instructions stored in the memory. The memory can be a separate component from the processor or can be included onboard within the processor. Alternatively, controller 150 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Controller 150 may operate upper heating element 118, lower heating element 119, and/or compressor 122 in order to heat water within interior volume 114 of tank 112. As an example, a user may select or establish a set temperature, $t_s$, for water within interior volume 114 of tank 112, or the set temperature $t_s$ for water within interior volume 114 of tank 112 may be a default value. Based upon the set temperature $t_s$ for water within interior volume 114 of tank 112, controller 150 may selectively activate upper heating element 118, lower heating element 119 and/or compressor 122 in order to heat water within interior volume 114 of tank 112 to the set temperature $t_s$ for water within interior volume 114 of tank 112. The set temperature $t_s$ for water within interior volume 114 of tank 112 may be any suitable temperature. For example, the set temperature $t_s$ for water within interior volume 114 of tank 112 may be between about one hundred degrees Fahrenheit and about one hundred and eighty-degrees Fahrenheit. As used herein with regards to temperature approximations, the term "about" means within ten degrees of the stated temperature.

Turning to FIGS. 5 through 7, exemplary check valve assembly 210 embodiments are illustrated. Generally, check valve assembly 210 may be disposed within or in fluid communication along sealed system 120 (see FIG. 2), as discussed above. As shown, check valve assembly 210 may include a valve body 212 that defines a discrete circuit inlet 220 and a circuit outlet 222. During operations, check valve assembly 210 may permit refrigerant to flow downstream from circuit inlet 220 to circuit outlet 222 along a defined fluid path 223. Refrigerant passing through circuit inlet 220 may be received from compressor 122 (see FIG. 2). Refrigerant passing through circuit outlet 222 may be directed to or toward condenser 124 (see FIG. 2).

In some embodiments, a charge port 224 is defined through valve body 212, e.g., through a sidewall of valve body 212. Charge port 224 may be positioned between circuit inlet 220 and circuit outlet 222. During select operations, refrigerant may be either interjected or intercepted through charge port 224. As an example, refrigerant may be selectively added to sealed system 120 by flowing refrigerant through charge port 224 into check valve assembly 210, e.g., for charging sealed system 120. Alternatively, refrigerant may be selectively and/or substantially removed from sealed system 120, e.g., for draining sealed system 120 prior to transport or maintenance.

A process tube 214 may be provided in fluid communication with valve body 212. Process tube 214 may be formed from one or more suitable conductive materials, e.g., copper. As illustrated, exemplary embodiments of process tube 214 extend to and optionally through charge port 224. Process tube 214 may be fixed to valve body 212 and may form a fluidly sealed connection, e.g., via brazing, at or adjacent to charge port 224. From charge port 224, process tube 214 extends to a defined process aperture 226. Between process aperture 226 and charge port 224, process tube 214 may direct refrigerant to or from valve body 212 along a defined fluid path 227. In optional embodiments, valve body 212 and process tube 214 each define a unique external diameter. Each of valve body 212 and process tube 214 may be formed as a substantially cylindrical body. Valve body 212 defines a first diameter D1 (e.g., maximum diameter) across (e.g., orthogonal to) the defined fluid path 223 from circuit inlet 220 to circuit outlet 222. Process tube 214 defines a second diameter D2 (e.g., maximum diameter) across (e.g., orthogonal to) the defined fluid path 227 from process aperture 226 to charge port 224. In exemplary embodiments, each diameter D1, D2 is formed according to and depend on the shape or size of the other. For instance, second diameter D2 may be formed to be less than first diameter D1. During certain operations, e.g., charging of sealed system 120, refrigerant may be supplied to process tube 214 through process aperture 226 before flowing downstream through the charge port 224 and the circuit outlet 222. During other operations, e.g., draining of the sealed system 120, refrigerant may be directed out of the process tube 214 at process aperture 226. For instance, at least a portion of refrigerant flowed through circuit inlet 220 may be directed through charge port 224 before exiting process tube 214 via the process aperture 226. In optional embodiments, a cap 228 (see FIG. 3) is selectively disposed on process tube 214, e.g., across process aperture 226. Cap 228 may provide a fluid seal over process aperture 226 and/or process tube 214 such that fluid flow into or through process tube 214 is substantially prevented.

Within valve body 212, a suitable one-way valve mechanism 230 (e.g., flap) may be provided. Generally, valve mechanism 230 may move or pivot in a single direction to prevent fluid from flowing in the opposite direction. A seal or seat 232 may be disposed forward from valve mechanism 230, restricting the range of motion for valve mechanism 230 and bracing the valve mechanism 230 against downstream pressure, i.e., pressure in a direction opposite from the direction of valve mechanism's movement, such as rotation from circuit outlet 222 toward circuit inlet 220. As illustrated in FIGS. 6 and 7, valve mechanism 230 may be disposed between circuit inlet 220 and circuit outlet 222. In some exemplary embodiments, such as that of FIG. 6, valve mechanism 230 is disposed downstream from charge port 224. Refrigerant or fluid from circuit inlet 220 flowing to circuit outlet 222 may pass charge port 224 before flowing across valve mechanism 230. Refrigerant or fluid from charge port 224 may flow across valve mechanism 230 before exiting circuit outlet 222. In other exemplary embodiments, such as that of FIG. 7, valve mechanism 230 is disposed upstream from charge port 224. Refrigerant or fluid from circuit inlet 220 must flow across valve mechanism 230 before passing across or through charge port 224. Refrigerant or fluid from charge port 224 bypasses valve mechanism 230 before exiting circuit outlet 222.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A sealed refrigeration system comprising:

a compressor operable to compress refrigerant;

a condenser disposed in downstream fluid communication with the compressor to condense refrigerant received from the compressor;

an evaporator disposed in fluid communication between the condenser and the compressor;

a check valve assembly disposed in fluid communication between at least two components of the sealed refrigeration system, the check valve assembly including a valve body defining a circuit inlet to direct refrigerant from the compressor within the sealed refrigeration system, a circuit outlet downstream from the circuit inlet to direct refrigerant therefrom, and a charge port between the circuit inlet and the circuit outlet to receive refrigerant therethrough;

a process tube extending through the charge port in fluid communication with the valve body;

a one-way valve mechanism disposed within the valve body between the circuit inlet and the circuit outlet, the one-way valve mechanism being pivotable forward in a first downstream direction to prevent fluid from flowing rearward in a second upstream direction opposite from the first downstream direction; and a seat disposed in a stationary rearward position from the one-way valve mechanism within the valve body to brace the one-way valve mechanism against rotation in the second upstream direction, wherein the valve body is formed as a hollow cylinder body defining an external first diameter, wherein the charge port defines an external second diameter that is less than the external first diameter.

2. The sealed refrigeration system of claim 1, wherein the check valve assembly is disposed in fluid communication between the compressor and the condenser.

3. The sealed refrigeration system of claim 2, further comprising:

a first copper conduit extending between the circuit inlet and the compressor in fluid communication therewith; and a second copper conduit extending between the circuit outlet and the condenser in fluid communication therewith.

4. The sealed refrigeration system of claim 1, wherein the one-way valve mechanism is disposed upstream from the charge port.

5. The sealed refrigeration system of claim 1, wherein the one-way valve mechanism is disposed downstream from the charge port.

6. An appliance comprising:

a heat exchange body including a sidewall defining an interior volume for receiving a fluid; and a sealed refrigeration system positioned in thermal engagement with the heat exchange body, the sealed refrigeration system comprising a compressor operable to compress refrigerant, a condenser disposed in downstream fluid communication with the compressor to condense refrigerant received from the compressor, an evaporator disposed in fluid communication between the condenser and the compressor, a check valve assembly disposed in fluid communication between at least two components of the sealed refrigeration system, the check valve assembly including a valve body defining a circuit inlet, a circuit outlet downstream from the circuit inlet, and a charge port between the circuit inlet and the circuit outlet to receive refrigerant therethrough, a process tube disposed through the charge port in fluid communication with the valve body to deliver refrigerant to the check valve assembly, a one-way valve mechanism disposed within the valve body between the circuit inlet and the circuit outlet, the one-way valve mechanism being pivotable forward in a first downstream direction to prevent refrigerant from flowing rearward in a second upstream direction opposite from the first downstream direction, and a seat disposed in a stationary rearward position from the one-way valve mechanism within the valve body to brace the one-way valve mechanism against rotation in the second upstream direction, wherein the valve body is formed as a hollow cylinder body defining an external first diameter, wherein the charge port defines an external second diameter that is less than the external first diameter.

7. The appliance of claim 6, wherein the check valve assembly is disposed in fluid communication between the compressor and the condenser.

8. The appliance of claim 7, further comprising:

a first copper conduit extending between the circuit inlet and the compressor in fluid communication therewith; and a second copper conduit extending between the circuit outlet and the condenser in fluid communication therewith.

9. The appliance of claim 6, wherein the one-way valve mechanism is disposed upstream from the charge port.

10. The appliance of claim 6, wherein the one-way valve mechanism is disposed downstream from the charge port.

11. A water heater appliance comprising:

a tank including a sidewall defining an interior volume; and a sealed system for heating water within the interior volume, the sealed system comprising a compressor operable to compress refrigerant, a condenser positioned on the tank and disposed in downstream fluid communication with the compressor to condense refrigerant received from the compressor, an evaporator disposed in fluid communication between the condenser and the compressor, a check valve assembly disposed in fluid communication between at least two components of the sealed system, the check valve assembly including a valve body defining a circuit inlet, a circuit outlet downstream from the circuit inlet, and a charge port between the circuit inlet and the circuit outlet to receive refrigerant therethrough, a process tube disposed through the charge port in fluid communication with the valve body to deliver refrigerant to the check valve assembly, and a one-way valve mechanism disposed within the valve body between the circuit inlet and the circuit outlet, the one-way valve mechanism being pivotable forward in a first downstream direction to prevent refrigerant from flowing rearward in a second upstream direction opposite from the first downstream direction, and a seat disposed in a stationary rearward position from the one-way valve mechanism within the valve body to brace the one-way valve mechanism against rotation in the second upstream direction, wherein the valve body is formed as a hollow cylinder body defining an external first diameter, wherein the charge port defines an external second diameter that is less than the external first diameter.

12. The water heater appliance of claim 11, wherein the check valve assembly is disposed in fluid communication between the compressor and the condenser.

13. The water heater appliance of claim 12, further comprising:

a first copper conduit extending between the circuit inlet and the compressor in fluid communication therewith; and a second copper conduit extending between the circuit outlet and the condenser in fluid communication therewith.

14. The water heater appliance of claim 11, wherein the one-way valve mechanism is disposed upstream from the charge port.

15. The water heater appliance of claim 11, wherein the one-way valve mechanism is disposed downstream from the charge port.

16. The water heater appliance of claim 11, wherein the sealed system further comprises:

a throttling device disposed in fluid communication between the condenser and the evaporator.

* * * * *